US005259032A

United States Patent [19]

Perkins et al.

[11] Patent Number: 5,259,032

[45] Date of Patent: Nov. 2, 1993

[54] CONTACT TRANSDUCER ASSEMBLY FOR HEARING DEVICES

[75] Inventors: Rodney C. Perkins, Woodside; Adnan A. Shennib, Fremont, both of Calif.

[73] Assignee: Resound Corporation, Redwood City, Calif.

[21] Appl. No.: 791,088

[22] Filed: Nov. 12, 1991

Related U.S. Application Data

[63] Continuation-in-part of Ser. No. 789,056, Nov. 7, 1991, abandoned, which is a continuation-in-part of Ser. No. 610,274, Nov. 7, 1990, abandoned.

[51] Int. Cl.[5] ..... H04R 25/00

[52] U.S. Cl. ..... 381/68; 381/68.3; 381/68.6

[58] Field of Search ..... 128/420.5, 420.6, 421; 381/68, 68.3, 68.2, 68.6; 73/627; 600/25; 623/10

[56] References Cited

U.S. PATENT DOCUMENTS

| | | | |
|---|---|---|---|
| 3,710,399 | 1/1973 | Hurst | 128/1.3 |
| 3,808,179 | 4/1974 | Gaylord | 260/86.1 E |
| 4,120,570 | 10/1978 | Gaylord . | |
| 4,248,899 | 2/1981 | Novicky | 526/264 |
| 4,303,722 | 12/1981 | Novicky | 526/279 |
| 4,357,497 | 11/1982 | Hochmair et al. | 381/68.3 |
| 4,540,761 | 9/1985 | Kawamura et al. | 526/245 |
| 4,756,312 | 7/1988 | Epley | 128/420.5 |
| 4,776,322 | 10/1988 | Hough et al. | 128/1.6 |
| 4,800,884 | 1/1989 | Heide et al. | 128/419 R |
| 4,817,607 | 4/1989 | Tatge | 128/419 R |
| 4,840,178 | 6/1989 | Heide et al. | 128/419 R |
| 4,936,305 | 6/1990 | Ashtiani et al. | 128/420.6 |
| 4,944,301 | 7/1990 | Widin et al. | 128/420.6 |
| 4,948,855 | 8/1990 | Novicky | 526/279 |
| 5,003,608 | 3/1991 | Carlson | 381/68.6 |
| 5,015,224 | 5/1991 | Mariglia | 600/25 |
| 5,015,225 | 5/1991 | Hough et al. | 128/420.5 |
| 5,031,219 | 7/1991 | Ward et al. | 381/68.5 |
| 5,061,282 | 10/1991 | Jacobs | 623/10 |
| 5,094,108 | 3/1992 | Kim et al. | 73/627 |
| 5,163,957 | 11/1992 | Sadé et al. | 128/420.2 |

OTHER PUBLICATIONS

Heide, et al., "Development of a Semi-Implantable Hearing Device", 1987, pp. 1-12.

Maniglia, et al., "Electromagnetic Implantable Middel Ear Hearing Device of the Ossicular-Stimulating Type Principles, Designs, and Experiments", 1988, pp. 3-16.

Rutchmann, "Magnetic Audition-Auditory Stimulation by Means of Alternating Magnetic Fields Acting on a Permanent Magnet Fixed to the Eardrum", 1959, pp. 22-23.

Decremer, et al., "Shape and Derived Geometrical Parameters of the Adult, Human Tympanic Membrane Measured with a Phase-Shift Moiré Interferometer", 1991, pp. 107-122.

Wilska, A., "Eine methode zur bestimmung der Horschwellenamplituden des trommelfells bei verschiedenen Frequenzen", Skand Arch Physiol. 72:161-165, 1935.

Wilska, A., "A direct method for determining threshold amplitudes of the eardrum at various frequencies. In Kobrak HG (ed): The Middle Ear. Chicago, University of Chicago Press", 1959, pp. 76-79.

Halliday, D. and Resnick, R., *Physics*, 3rd. ed., J. Wiley, New York, 1978, pp. 99-100.

Kinloch, A. J., *Adhesion and Adhesives Science and Technology*, 1st. Ed., Chapman and Hall, Cambridge University Press, London (1987), p. 185.

*Primary Examiner*—Jin F. Ng

*Assistant Examiner*—William D. Cumming

*Attorney, Agent, or Firm*—McCubbrey, Bartels, Meyer & Ward

[57] ABSTRACT

A contact transducer assembly for an electromagnetically driven hearing device such as a hearing aid or other audio signal reproducing device worn by a user is described. The contact transducer assembly includes a transducer which is attached to a biocompatible support. This assembly is supported on the tympanic membrane of the wearer by surface adhesion, such that it can be readily inserted and removed in a manner similar to that of a conventional contact lens worn on the eye.

20 Claims, 3 Drawing Sheets

CONTACT TRANSDUCER ASSEMBLY FOR HEARING DEVICES

BACKGROUND OF THE INVENTION

1. Field of the Invention

This application is a continuation-in-part of application Ser. No. 07/789,056, filed Nov. 7, 1991 now abandoned, which is a continuation-in-part of application Ser. No. 07/610,274, filed Nov. 7, 1990 now abandoned.

The present invention stems and, in particular, to hearing systems that enable or enhance an individual's ability to hear by imparting vibrations to the tympanic membrane.

2. Description of the Prior Art

At the present time, most hearing systems rely on acoustic transducers that produce amplified sound waves which, in turn, impart vibrations to the tympanic membrane or eardrum. The telephone earpiece, radio, television and aids for the hearing impaired are all examples of systems that employ acoustic drive mechanisms. The telephone earpiece, for instance, converts signals transmitted on a wire into vibrational energy in a speaker which, in turn, vibrates the tympanic membrane. These vibrations, at varying frequencies and amplitudes, result in the perception of sound by a person with normal hearing.

Hearing systems that deliver audio information to the ear through electromagnetic transducers are well known. These transducers convert electromagnetic fields, modulated to contain audio information, into vibrations which are imparted to the tympanic membrane or parts of the middle ear. The transducer, typically a magnet, is subjected to displacement by electromagnetic fields to impart vibrational motion to the portion to which it is attached, thus producing sound perception by the wearer of such an electromagnetically driven system. This method of sound perception possesses some advantages over acoustic drive systems in terms of quality, efficiency, and most importantly, elimination of "feedback," a problem common to acoustic hearing systems.

Feedback in acoustic hearing systems occurs when a portion of the acoustic output energy returns or "feeds back" to the input transducer (microphone), thus causing self-sustained oscillation. The potential for feedback is generally proportional to the amplification level of the system and, therefore, the output level of many acoustic drive systems has to be reduced to less than a desirable level to prevent a feedback situation. This problem, which results in output inadequate to compensate for hearing losses in particularly severe cases, continues to be a major problem with acoustic type hearing aids. Electromagnetic hearing systems, on the other hand, rely on electromagnetic energy output and therefore, the potential for feedback is essentially eliminated (Bojrab, 1988).

Developing a satisfactory prosthesis for electromagnetic drive hearing systems is not trivial. Initial attempts in the prior art at demonstrating the necessary energy coupling concepts consisted of attaching magnets or small pieces of iron to the tympanic membrane using an adhesive, and stimulating them with current-carrying coils placed into the ear canal (Goode, 1989, citing Wilska, 1959). The energy requirement to produce adequate vibration of the tympanic membrane rendered all attempts impractical until the advent of strong rare earth magnets in 1979 (Bojrab, 1988).

Later attempts at installation of magnets in the ear for use with electromagnetic hearing systems involved surgical methods to attach magnet assemblies on the malleus, incus, stapes, or by incorporating magnets within middle ear replacement prostheses. Other methods were even more invasive, requiring extensive hardware implanted in the middle ear cavity (Hurst, 1973; Goode, 1973; Heide, et al. 1989; and Maniglia, et al., 1988). Less invasive methods used glue or similar adhesives to attach magnets to the tympanic membrane (Rutschmann, et al., 1958; Rutschmann, 1959; Heide, et al., 1987).

Aside from gluing techniques, all other approaches to the installation of magnets in the ear for use with electromagnetic drive systems involve invasive surgical procedures with their associated risks, as well as the time, expense, and required skill and knowledge to perform implant procedures. The performance of such systems has to date been marginally acceptable due to technical limitations relating to magnet size, coil-magnet proximity, power requirements, and the available space to install the necessary hardware.

The use of adhesives to attach magnets to the tympanic membrane, and particularly to the umbo region of the tympanic membrane, is not yet practical. It is not known how long a magnet glued to the tympanic membrane will stay attached, nor is it known whether adhesives will have any long term deleterious effect on the underlying tissue. For those instances where temporary electromagnetic drive sound enhancement is sought, for example as a television prompter, the glued magnet is not easily removable when desired, and the use of solvents for removal may be required. Furthermore, even if it were possible to overcome the foregoing problems, a glued magnet could be subject to migration, over time, to other locations on the eardrum due to epithelial growth and motion of the underlying tissue.

It is therefore an object of the current invention to provide a non-invasive method for imparting audio information to an individual by means of electromagnetic waves, which enhances the wearer's general ability to either perceive sound, or to selectively receive personal communication signals.

It is also an object of the current invention to provide a biocompatible supported contact transducer assembly, for use with hearing systems, that is non-invasive and attaches to a portion of the ear without the need for adhesives, or the need for surgical procedures.

It is a further object of the current invention to provide a contact transducer assembly of imperceptible design that can be facilely installed and removed with minimal effort, attaches to the tympanic membrane, and imparts vibrations thereto.

It is still a further object of the current invention to provide a method for the installation of a contact transducer assembly for use with hearing systems that is substantially supported weakly but sufficiently on the tympanic membrane without the use of adhesives or invasive procedures.

A more general object of the current invention is to provide an improved hearing system which is unobtrusive and which has elements which are easily taken on and off of a user.

SUMMARY OF THE INVENTION

The present invention discloses a system and method which employs a device for producing electromagnetic signals containing audio information, and a contact transducer assembly which is weakly but sufficiently, and removably, affixed to the tympanic membrane of the wearer by surface adhesion. The contact transducer assembly of the present invention comprises a transducer which is responsive to electromagnetic signals to produce vibrations that represent the audio information.

The transducer is supported, at least in part, by a biocompatible structure having a contact surface with a surface area and configuration sufficient to support the transducer at a desired location on the tympanic membrane, and in vibrationally coupled relationship to the tympanic membrane. The present invention thus enables the wearer of the contact transducer assembly to conveniently and facilely install or remove the assembly when the particular application has ended, or for routine cleaning, maintenance, etc. In this respect, the installation and removal of the contact transducer assembly is much like the method for insertion and removal of conventional contact lenses for the eyes.

DEFINITIONS

Figure 1:
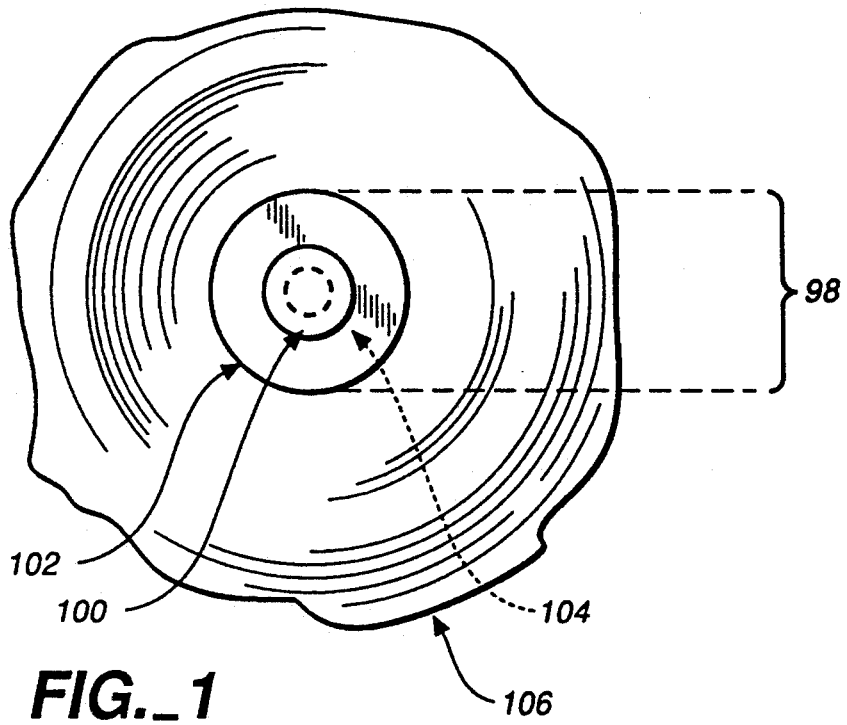
FIG. 1 is a schematic top view of the contact transducer assembly according to one embodiment of the present invention showing the placement of the contact transducer means in relation to the support means, and the location of the device on tympanic membrane of the wearer.

In the present specification and claims, reference will be made to phrases and terms of art which are expressly defined for use herein as follows:

As used herein, a biocompatible material is one that is non-toxic, and is neither rejected by nor degrades biological tissue to which it is proximate or with which it is in contact.

As used herein, a "custom membrane" is a layer of a biocompatible material that supports the contact transducer assembly against the tympanic membrane, at least a portion of the layer substantially conforming to the surface topography of a corresponding portion of the tympanic membrane. Typically, a custom membrane is fabricated by making a negative impression of an individual's tympanic membrane, casting a positive mold of the negative impression, and then applying a layer of biocompatible material to the positive mold that will substantially match the surface topography of the tympanic membrane.

As used herein, an "adhesive", the word being used as a noun, is intended to mean a substance which effects adhesive bonding between two adjacent surfaces. Adhesive bonding can occur in either of two ways: (1) by chemical forces at the interface between the adhesive and the two surfaces being joined; or, (2) by mechanical adhesion that involves an interlocking action at the molecular level between the adhesive and the materials being joined.

As used herein, the term "surface adhesion" means weak molecular attraction or mechanical interlocking between two surfaces of respective items without the use of an intermediate adhesive. The items joined are relatively inert, non-reactive, and retain their initial physical properties. Slight pressure and/or a wetting agent may be utilized to facilitate surface adhesion.

As used herein, "non-reactive" means a material whose chemical and physical state does not change in time, such as through evaporation of some component or through chemical cross-linking, such that the material is either unstable or loses its ability to function properly.

As used herein, "vibrationally coupled" means mutually engaged elements wherein substantially all vibrations produced in one element are imparted to the other causing the other to vibrate correspondingly.

As used herein, a "high energy permanent magnet" includes rare earth permanent magnets, or magnets of other materials which have a similar interactive response to variations in magnetic fields.

As used herein, "impermanent attachment" signifies a method that uses surface adhesion to weakly but sufficiently support a contact transducer assembly against the tympanic membrane of an individual according to the teaching of the current invention, without having to use surgical techniques or reactive adhesives.

As used herein, "manually releasable" means impermanent attachment wherein the weak but sufficient forces of surface adhesion may be easily overcome by manual manipulation of the transducer assembly without damage to the tympanic membrane or discomfort to the wearer.

As used herein, a "surface wetting agent" is a substance that enhances the ability of a surface to form a weak, but sufficient, attachment to another surface through surface adhesion. Surfaces can be roughly divided into two categories: hydrophobic (water-hating) and hydrophilic (water-loving). A surface wetting agent is a material that has similar surface characteristics, either its hydrophobicity or hydrophilicity, to the adjacent surface. Because of their similarities, a surface wetting agent will spread on the surface in question and form a thin film which, in turn can become a vehicle of adhesion to another surface. A wetting agent can therefore promote the adhesion between two surfaces. The adhesion between the non-reactive, preformed contact transducer assembly and the non-reactive tympanic membrane may be enhanced by the use of surface wetting agents.

When a surface wetting agent is used, the surface wetting agent forms a thin film through strong attractive forces and enhances the natural surface adhesion phenomenon between surfaces. The purpose for using surface wetting agents with the contact transducer assembly of the current invention is analogous to the use of wetting solutions for contact lens applications.

As used herein, a "transducer" may comprise a magnet or magnetic particles dispersed throughout a membrane or attached structure, a coil or multiple coils, piezoelectric elements, passive or active electronic components in discrete, integrated, or hybrid form, or any singular component or combination of components that will impart vibrational motion to the tympanic membrane in response to appropriately received signals or any other means suitable for converting modulated electromagnetic waves to vibrations.

As used herein, the "umbo area" is the conical depression at the center of the tympanic membrane where it attaches to the inferior end of the malleus.

As used herein, "unaided hearing" means hearing without the use of an electromagnetic drive system.

As used herein, "weakly but sufficiently" and "weak but sufficient" both describe the qualities of the surface adhesion attachment forces with which a contact transducer assembly of the current invention is supported on a portion on the eardrum. An object that is weakly but sufficiently attached will remain situated in place during use without shaking loose when vibrated or when the individual wearing the device is jarred or moves about. The normal activity of the individual wearer of the device will not easily dislodge the assembly, yet the assembly can be facilely installed or removed manually. Weak but sufficient forces hold the assembly in place in the presence of vibrations and without the need for adhesives, and may be overcome by manual manipulation without damage to the tympanic membrane or discomfort to the user.

DETAILED DESCRIPTION OF THE INVENTION

The hearing system of the current invention comprises a signal producing means for producing electromagnetic signals that contain audio information, and a tympanic membrane contact transducer assembly which receives said signals and imparts vibrations to the ear. Said signal producing means and said contact transducer assembly will be described in greater detail with reference to the accompanying Figures. It should be noted that like numerals are employed to designate like parts throughout the Figures.

FIG. 1 depicts a top view of contact transducer assembly 98 of the present invention, which is further comprised of transducer means 100, and support means 102. Support means 102 is generally circular as viewed in FIG. 1 and is attached to transducer means 100 on one surface (the top surface in FIG. 1) of support means 102. Support means 102 is then attached to a portion of the tympanic membrane 106 at the opposite surface (the undersurface in FIG. 1) of support means 102. In the preferred embodiment of the current invention, the second surface of support means 102 that is attached to the tympanic membrane substantially conforms to the shape of the corresponding surface of the tympanic membrane, particularly the umbo area 104.

In the preferred embodiment of the current invention, transducer means 100 is substantially tapered, such as a conically frusto-conical pyramidally shaped magnet, as further described below. The smaller base is positioned toward the eardrum so that it fits within the depression in the umbo area. An advantage of this configuration is that the center of mass of the relatively heavy magnet is maintained close to the cardum to minimize torque resulting from gravity or vibration. In alternate embodiments of the current invention, transducer means 100 may also be cylindrical rectangular or pillow-shaped. Other shapes for transducer means 100 are also possible and will be readily apparent to those skilled in the pertinent art.

FIG. 1 also shows transducer means 100 substantially centrally located on support means 102 according to the preferred embodiment of the current invention. The undersurface of support means 102 has a surface area and configuration sufficient to support transducer means 100 by manually releasable surface adhesion on the tympanic membrane. Although support means 102 is circular in the preferred embodiment of the current invention, support means 102 may take on any of a variety of alternate shapes, as will be readily apparent to those skilled in the pertinent art.

As depicted in the preferred embodiment of FIG. 1, support means 102 has a larger diameter than transducer means 100. Depending upon the needs of the individual and/or the application for which contact transducer assembly 98 is used, the outer dimension(s) of support means 102 may more closely approximate the outer dimension(s) of transducer means 100. The degree of surface adhesion required to weakly attach contact transducer assembly 98 to the tympanic membrane is a factor in determining the surface area and therefore the optimal size for support means 102.

Contact transducer means 98 is shown on a portion of tympanic membrane 106 in FIG. 1. In the preferred embodiment of the current invention, contact transducer means 98 is positioned against umbo area 104. There may be alternate optimal locations for contact transducer assembly 98 as will be apparent to those skilled in the pertinent art.

FIGS. 2A through 2F show a number of different cross-sectional views of contact transducer assembly 98 in greater detail. In the preferred embodiment of the current invention, transducer means 100 comprises a magnet 2 and, in particular, a permanent magnet. Said permanent magnet may further comprise a high energy rare earth magnet such as samarium-cobalt, neodymium-iron-boron, or any other high energy permanent magnet material as appropriate. In an alternate embodiment of the invention illustrated in FIG. 2F, transducer means 100 may comprise magnetic particles dispersed throughout a membrane or other structural portion of the support means 102.

Alternately, transducer 2 may comprise a coil or multiple coils, piezoelectric elements, passive or active electronic components in discrete, integrated, or hybrid form, or any singular component or combination of components that will impart vibrational motion to the tympanic membrane in response to appropriately received signals or any other means suitable for converting signals means to vibrations. Such variables are possible, conceivable, and are within the contemplated description of the contact transducer assembly according to the present invention.

Figure 2A:
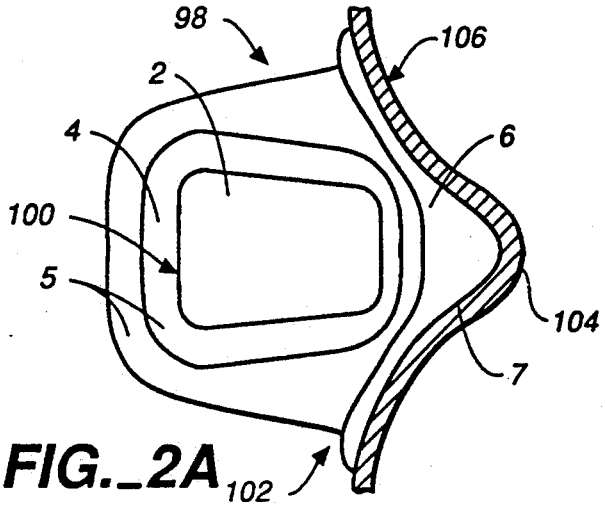
FIGS. 2A through 2F are several schematic side and cross-sectional views for different embodiments of the present invention.

FIGS. 2A through 2F, show cross-sections of transducer means 100 and support means 102 of contact transducer assembly 98. FIG. 2A shows one embodiment of the current invention in which transducer means 100 is comprised of a frusto-conical magnet 2, and wherein the support means 102 includes a housing 4. The housing 4 includes two layers 5 of biocompatible material. In the preferred embodiment, frusto-conically shaped magnet 2 is completely enclosed within the layers 5 of biocompatible material. The layers 5 may be comprised of the same or different materials, and each layer may be further comprised of a composite of materials or a plurality of layers. The outer one of layers 5 is additionally attached to membrane or interface 6 at a surface opposite that of the tympanic membrane.

The purpose for housing 4 is to impart protection to the transducer from the physiological environment of the wearer, which includes air, water and salts, or other substances in close proximity to the ear canal of an individual with which magnet 2 could potentially react. Housing 4 therefore helps to ensure greater durability and longevity of magnet 2.

Figure 2D:
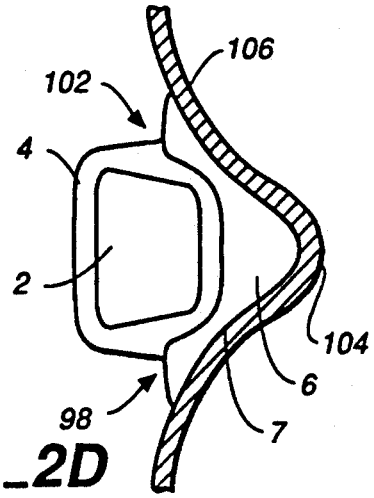

Housing 4 also functions to prevent any biological degradation of the tissue surrounding transducer means 100. In instances where transducer means 100 is perceived as an irritant or is otherwise invasive to the body, or in those situations where the material of which transducer means 100 is comprised is not fully biocompatible, the biocompatible material of housing 4 ensures that transducer means 100 will be capable of being worn by the individual without discomfort or deleterious side effects. Alternately, in further embodiments consistent with the teaching of the current invention, transducer means 100 does not include a housing 4. Moreover, the housing 4 may be comprised of a plurality of layers 5 of biocompatible material, two examples of which are illustrated at FIGS. 2C and 2E.

FIG. 2A also shows support means 102 of contact transducer assembly 98 supported against the umbo area 104 of tympanic membrane 106. The interface 6 has a contact surface 7 which engages the tympanic membrane 106. The area and configuration and material for the surface of is selected so that surface adhesion, either inherent or with the aid of a surface wetting agent, attaches support means 102 weakly but sufficiently to tympanic membrane 106. Further discussion of surface wetting agents will be found below. Interface layer 6 of support means 102 may be comprised of a plurality of layers, depending upon the fabrication, use, etc., of the particular prosthesis.

Figure 2B:
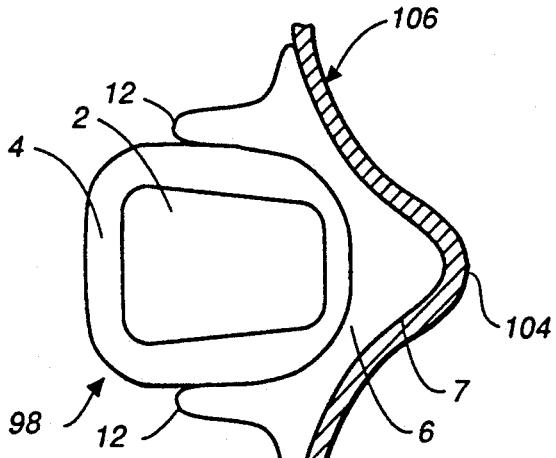
Figure 2E:
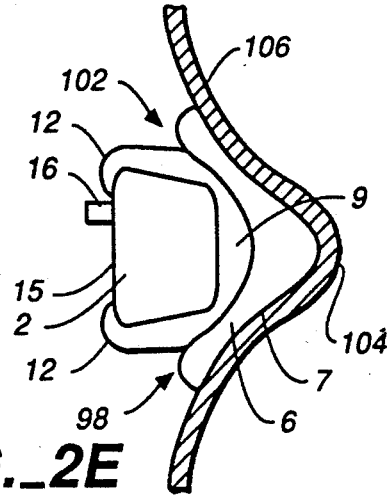
Figure 2C:
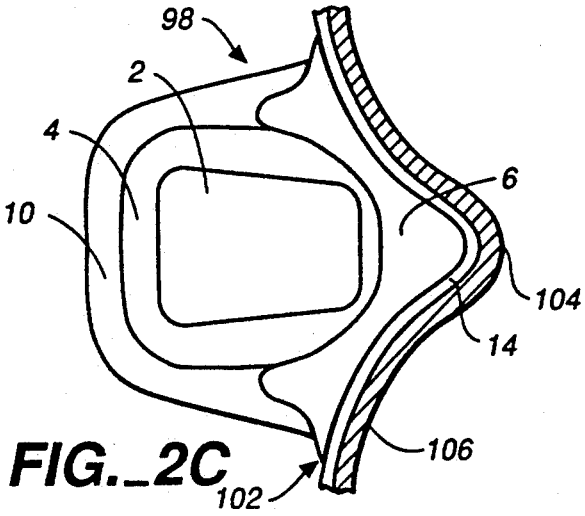

FIG. 2B shows an alternate embodiment of the prosthesis of the current invention, in which transducer means 100 is comprised of a magnet 2 and a single layer biocompatible housing 4. As described earlier for the preferred embodiment of the current invention, housing 4 completely encapsulates the frusto-conically shaped magnet 2. Sufficient provision for attachment of the housing 4 to the interface or membrane of the support means 102 is provided in the embodiment of the current invention depicted in FIG. 2B by a lip 12 of interface 6. The embodiment of FIG. 2B is supported directly by surface adhesion at the contact surface 7 of interface 6. In the preferred embodiment of the current invention, the contact surface 7 of interface 6 conforms to the shape of tympanic membrane 106 at the umbo region 104.

In applications where a custom fit of contact transducer assembly 98 to the eardrum of an individual is desired, interface 6 may be comprised of a custom membrane. To fashion a custom membrane, a negative impression of the eardrum of an individual is first made, for example as described below. A positive mold is then created, and a biocompatible material is then cast or molded from the positive impression to create a biocompatible interface 6 for support means 102 that ultimately attaches to the eardrum of the individual. Other custom molding or casting techniques may also be suitable.

A non-custom interface may also be produced using a suitable material which is non-reactive but malleable to conform with the surface of the eardrum. A non-custom contact transducer assembly may be manufactured be determining a base shape or set of base shapes that will fit most tympanic membranes. The shape of a large number of eardrum may be determined in accordance with the techniques described in Decraemer, et al., 1991. Standard mathematical clustering techniques such as those used by contact lens manufacturers, may then be used to classify shapes according to their similitude. One or more shapes may then be selected, by trial and error or by measurement of portions of the eardrum, such as the depth of the umbo depression, the angle of the manubrium, and the diameter of the eardrum.

An illustration of a prosthesis of the current invention with a custom membrane is shown in FIG. 2C. The magnet 2 is covered by a biocompatible housing 4, and biocompatible layer 10. According to the embodiment of the current invention shown in FIG. 2C, frusto-conically shaped magnet 2 is completely surrounded by the biocompatible housing 4, which in turn is attached to the outer surface of the interface 6. Biocompatible layer 10 partially encloses biocompatible housing 4, and further attaches to the outer surface of interface 6.

Also according to the embodiment of the current invention shown in FIG. 2C, a thin layer of surface wetting agent 14 is provided on the contact surface 7 of biocompatible interface 6 disposed against and conforming to the shape of tympanic membrane 106 at the contact surface 7. Surface wetting agent 14 is used to enhance the ability of support means 102 to form a weak but sufficient attachment to the tympanic membrane 106 through surface adhesion.

In the preferred embodiment of the current invention, surface wetting agent 14 is comprised of a non-reactive material, unlike glue or epoxy, which are hardening reactive adhesives. Surface wetting agents have relatively high intermolecular attractive forces with the adjacent surfaces if they have similar characteristics, e.g., hydrophobic or hydrophilic. The function of surface wetting agent 14 is to provide enhanced capability for contact transducer assembly 98 to form a sufficient, but weak adhesion to the tympanic membrane. Mineral oil has been used successfully as a surface wetting agent, and as a spray periodically used after placement of the device.

Figure 2F:
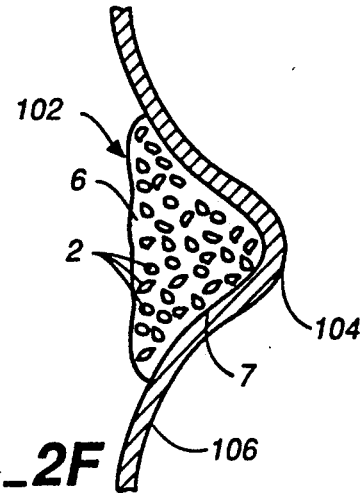

FIG. 2D illustrates the placement of contact transducer assembly 98 against the tympanic membrane without the use of a surface wetting agent. Unlike magnet 2 of FIGS. 2C, 2D, and 2E above, magnet 2 in FIG. 2F is attached directly to biocompatible interface 6 of support means 102, and housing 4 only partially encapsulates magnet 2. Again, magnet 2 is shown frusto-conically shaped according to the preferred embodiment of the current invention. Additionally, magnet 2 is attached directly to a portion of a first surface of biocompatible interface 6. Housing 4 only partially encapsulates magnet 2 and attaches to interface 6 along that portion of the first surface to which magnet 2 is not attached.

Also according to the embodiment of the current invention illustrated in FIG. 2D, support means 102 includes biocompatible interface 6 which conforms to, and is supported against, tympanic membrane 106 at a surface 7 opposing magnet 2. Interface 6 matches the curvature of tympanic membrane 106 at umbo area 104.

FIG. 2E likewise shows the current invention with the additional feature of a positioning means. In the embodiment of the current invention illustrated in FIG. 2E, positioning means 16 is attached to magnet 2 at a first surface 15 of the magnet. In this particular embodiment of the current invention, positioning means 16 is located asymmetrically along first surface 15 of magnet 2. Support means 102 is attached directly to the magnet 2 along a surface thereof opposite surface 15. In this view, support means 102 includes a layer 9 which partially encloses the magnet 2 at lip 12. The layer 9 is attached to the interface or membrane 6. The shape of biocompatible interface 6 conforms to that of the tympanic membrane 106 at the umbo.

Positioning means 16 may be useful for achieving proper alignment of the prosthesis on the tympanic membrane. Positioning means may also be used for engaging a self-insertion instrument. Such instrument may be used for insertion or removal of contact transducer assembly 98 in further embodiments of the current invention. Although depicted in FIG. 2E as protruding from a surface 15 of magnet 2 according to the preferred embodiment of the current invention, positioning means 16 may also comprise such modifications as a notch or a raised section either on a third surface of the magnet 2 not in contact with the support means 102 or disposed opposite to support means 102.

FIG. 2F illustrates an embodiment wherein the magnet 2 is composed of a plurality of magnetic particles molded into and distributed throughout the membrane 6 of the support means 102.

Figure 3:
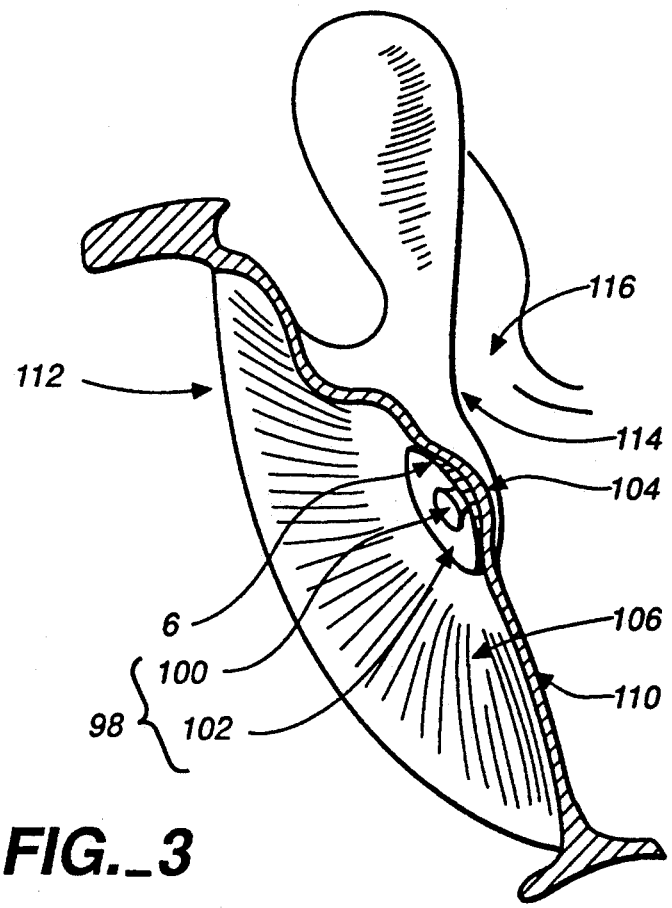
FIG. 3 shows a cut-away view of one contact transducer assembly of the present invention and a cut-away view of the umbo region of the tympanic membrane showing the approximate location of the device on the tympanic membrane of the wearer in one embodiment of the present invention; and, FIG. 4 is a schematic diagram showing the approximate placement of the contact transducer assembly on the tympanic membrane in one embodiment of the current invention, and the relationship of the tympanic membrane at the end of the ear canal to the outer ear of the individual.

FIG. 3 shows a simplified illustration of contact transducer assembly prosthesis 98 and its approximate placement on umbo area 104 of tympanic membrane 106 according to the preferred embodiment of the current invention. Transducer means 100 is attached to a first surface of support means 102, which likewise is positioned against tympanic membrane 106 at a second or contact surface opposite to that of transducer means 100. A partial cut-away view of support means 102 (showing biocompatible interface 6) and transducer means 100 are shown supported against cut-away portion 1 1 0 of tympanic membrane 106. FIG. 3 also depicts a portion of ear canal 112, which ends at, and is separated from the middle ear by, tympanic membrane 106. Against the opposite side of tympanic membrane 106 and part of the middle ear is malleus 114, to which is likewise attached incus 116. Malleus 114 and incus 116 are shown relative to tympanic membrane 106 in order to indicate relative location to ear canal 112 and the tilt of tympanic membrane 106 with the prosthesis of the current invention attached.

Figure 4:
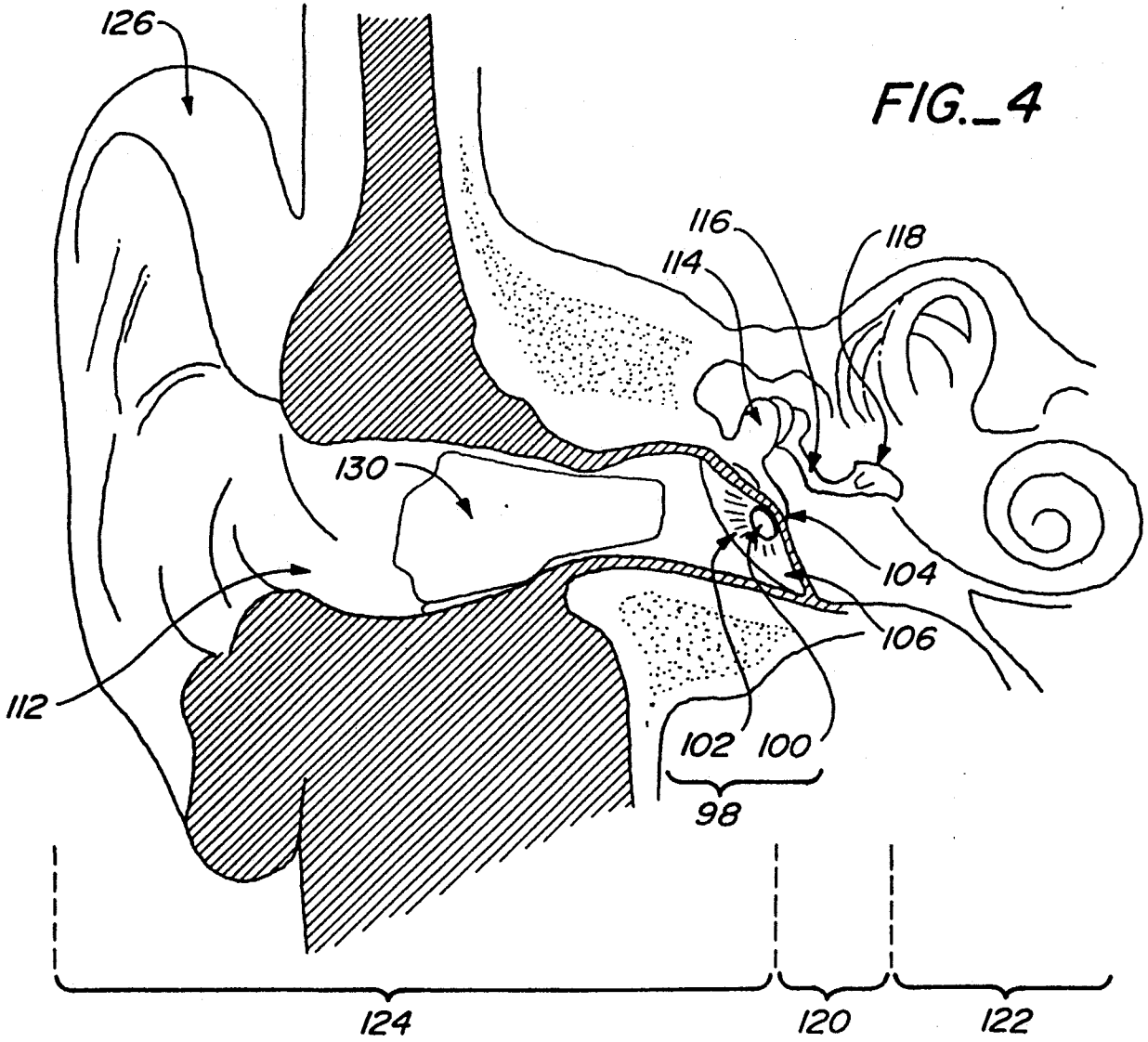

FIG. 4 depicts a larger cross-section of outer ear 124, middle ear 120 and inner ear 122 (part). The relative degree of tilt of contact transducer assembly 98 on umbo area 104 is shown with respect to signal producing means 130, and ear canal 112 and right pinna 126 of an individual. In the preferred embodiment of the current invention, contact transducer assembly (comprising transducer means 100 and attached support means 102) is positioned against tympanic membrane 106 at umbo area 104. The placement of contact transducer assembly 98 is also shown relative to the locations of malleus 114, incus 116, and stapes 118 of inner ear 122. Inner ear 122 is likewise adjacent to middle ear 120.

As described above, a hearing system according to the current invention comprises signal producing means 130 for producing signals that contain audio information, and a contact transducer assembly which receives said signals and imparts audio information to an individual. In the preferred embodiment of the current invention, the information that signal producing means 130 transmits is in the form of electromagnetic energy, and transducer means 100 comprises a permanent magnet. In such a preferred embodiment, electromagnetic signals impinging upon said permanent magnet cause said magnet to vibrate. Since transducer means 100 is vibrationally coupled to tympanic membrane 106, mechanical vibrations at transducer means 100 cause the individual wearer to perceive the vibrational energy in the form of sound. The signal producing means may comprise any suitable device operating in accordance with known principles to produce an electromagnetic field modulated to contain audio information. Such audio information can be captured by a microphone, as in a conventional acoustic hearing aid, or may be captured by other means such as an FM receiver. The electromagnetic field may, for example, be generated by passing electrical current signals modulated to contain audio information through a coil.

As will be readily apparent to those skilled in the relevant art, many types of signals can be used to transmit information representative of audio information to signal producing means 130 and thereby impart vibrational motion to the tympanic membrane. For instance, signal producing means 130 may be used to receive radio frequency (RF) signals or ultrasound energy. Signal producing means 130 may also have a variety of shapes and orientations, as will be readily apparent to those skilled in the relevant art.

In the preferred embodiment of the current invention depicted in FIG. 4, signal producing means 130 is located at a particular position within ear canal 112. However, signal producing means 130 may also be placed at different locations within ear canal 112. In still other embodiments of the current invention, signal producing means 130 may also be placed external to the ear canal.

A number of contact transducer assemblies that were fabricated according to the current invention were studied, and the surface adhesion forces with which they held onto substrates has been recorded. In one series of experiments, the strength of the surface adhesion was determined to be equivalent to 3.94 mNt (milliNewton). This is comparable to a static force strength of 130 dB SPL (Sound Pressure Level). Since the tympanic membrane is actually dynamic and not rigid, the tympanic membrane will absorb most of the vibrational energy that is imparted to the prosthesis. This causes an apparent adhesion between the prosthesis and the tympanic membrane sufficient to withstand pressures greater than 130 dB SPL. Furthermore, since the push-pull forces on the prosthesis are much weaker than the surface adhesion forces, the prosthesis will remain mounted on the tympanic membrane until manually removed by the wearer of the device.

To further illustrate the foregoing described invention, the following examples are provided of devices which have been constructed and successfully tested. The provision of the following examples is not intended to limit the scope of the invention, but such examples are given for illustrative purposes only.

EXAMPLE 1

A contact transducer assembly was manufactured by the following procedures. A medical doctor took a negative impression of the eardrum of a patient following the protocol set out in Appendix A attached hereto. A positive mold was then prepared from the negative impression using a room temperature curing acrylic polymer comprised of audacryl RTC and methyl methacrylate using techniques as described in Appendix A. The resulting positive acrylic polymer mold thus had the shape and size of the surface of the patient's eardrum in the umbo area.

Using the positive mold, the contact transducer assembly was constructed as follows. A very small drop of premixed Dow Corning SILASTIC® silicone elastomer medical grade MDX4-4210 (ten parts of base and one part of curing agent) was placed onto the umbo area of the positive mold to make a thin film in the umbo area. Alternatively, the silicone polymer may first be distributed around the circumference of the umbo area to form a dam defining the diameter of the final device, followed by filling the defined area with additional silicone polymer. In either case, the thin film forms the interface or membrane of the support means of the contact transducer assembly. The diameter of the resulting membrane varied between 4 and 6 millimeters and the thickness of the membrane was less than one millimeter. The surface of the membrane facing against the positive mold was of the configuration of the outer surface of the patient's eardrum in the umbo area.

A magnet was utilized as the transducer 100. The magnet was a rare-earth-Samarium-Cobalt (SmCo) type having magnetic energy of 32 MGOE or higher and was frusto-conical having dimensions of approximately 2 mm large dia. by 1 mm small dia. by 1.5 mm high. The magnet was purchased from Seiko Instrument in Sendai, Japan. The magnet was electroplated with two layers of nickel and one layer of gold. The thickness of both layers of nickel was about 50 micrometers and the thickness of the gold layer was about 5 micrometers. The gold plated magnet was then coated with the same silicone polymer as was used to form the membrane. This was done by rotating the magnet in a small puddle of the silicone material. The coating was less than one millimeter thick and formed the housing for the magnet.

The coated magnet was then placed onto the membrane formed on the positive mold. The entire assembly of positive mold, silicone polymer membrane, and silicone polymer coated magnet, was placed in a preheated oven at 100° C. for 15 minutes. After oven curing, the housing bonded to the membrane, thus supporting the magnet in the assembly. The coated magnet and membrane assembly was then removed from the positive mold using surgical instruments. The resulting contact transducer assembly was disinfected using isopropyl alcohol and was then slightly lubricated with mineral oil. Shipment of the device may be accomplished by placing the contact transducer assembly back onto the positive mold in a suitable package. Placement of the contact transducer assembly on the patient's eardrum was accomplished by a medical doctor using a non-magnetic instrument while using a microscope. The patient experienced no discomfort on placement and after wearing the device for an extended period of time. The patient was able to hear normally and at the same time was able to receive audio information transmitted as described above to the contact transducer assembly in a clear and unobtrusive manner.

EXAMPLE 2

A positive mold was produced from a negative eardrum impression as described above in Example 1 using materials identical to those used for the negative impression. Instead of silicone elastomer for the membrane a polymer was prepared using the following components. Three predistilled and refrigerated monomers were mixed at the following weight ratio: methylmethacrylate (50%), hexafluoroisopropyl methacrylate (25%) and tris-(trimethylsiloxy)-3 methacryloxypropylsilane (25%). The initiator AIBN, azo-bis(isobutyl) nitrile was added at the 0.2% weight level to the mixed monomers to initiate polymerization. Nitrogen was provided as a purge gas for the monomer mixture prior to polymerization. Polymerization was carried out at 75° C. for 22 hours. The polymerization was followed by curing at the same temperature for an additional 17 hours. Following polymerization, the polymer was dissolved in ethyl acetate at a concentration of 10% by weight.

The magnet was as described in Example 1 and was electroplated with two layers of nickel and a final layer of gold. The thickness of both layers of nickel was about 50 mircometers and the thickness of the gold layer was about 5 micrometers.

A small drop of the polymer solution was placed onto the umbo area of the positive mold to produce the interface or membrane of the support structure. Placement was accomplished using a dropper and placing one drop at a time, waiting between drops until the previous drop became semi dry or sticky. The final diameter of the membrane was between four and six mm. After building up the thickness of the membrane to slightly less than one millimeter, and while the membrane was still sticky, the gold plated magnet was placed onto the center of the umbo area and two more smaller drops of polymer solution were applied to coat the magnet and thus form the housing. The surface of the membrane opposite the magnet and adjacent the positive mold conformed to the shape of the patient's eardrum in the umbo area.

The contact transducer assembly, while on the positive mold, was then air dried. After drying, the contact transducer assembly was carefully removed from the positive mold using surgical instruments. Transport and packaging of the contact transducer assembly may be accomplished as in Example 1 using the positive mold as a support.

The device thus manufactured in this example was placed against a patient's ear drum by a medical doctor using a non-magnetic instrument and while using a microscope. No discomfort was experienced by the patient during and after placement and the device functioned as described in Example 1.

A hearing system according to the current invention may be used by hearing impaired persons, or by persons with normal hearing who want to receive audio information selectively. In one application, an individual who might want to receive a foreign language translation could temporarily use a signal producing means and an appropriate contact transducer means preset to impart the appropriate language to the individual. Other applications can involve systems in which an individual might want to receive certain direct information to the exclusion of others. Examples of the latter situations include sports events, public fora, simultaneous broadcasts of radio or television programs, etc. These and other examples will be apparent to those skilled in the appropriate art.

From previous research, it is known that using magnets glued onto the tympanic membrane with weights on the order of 25 mg to 50 mg is optimal for hearing impaired persons. For non-hearing impaired persons, the range is somewhat less. Magnet weights in excess of 50 mg have been shown to cause significant effects on unaided hearing (hearing without the use of an electromagnetic drive system). On the other hand, if the magnet is too lightweight, the magnetic energy is too weak to impart significant vibrations to the ear.

Using prostheses according to the current invention, it has been shown that acceptable results can be achieved with a weight of approximately 30 mg (for hearing impaired persons). In one instance, a 33 mg weight contact transducer assembly according to the current invention was successfully worn by an individual for over two months. Furthermore, no significant effect was found on the unaided hearing, as verified by audiogram measurements both before and after prosthesis placement on the tympanic membrane.

The foregoing disclosure and description of the invention are illustrative and explanatory of the invention, and various changes in the size, shape, materials and components, as well as in the details of the illustrated construction and method may be made without departing from the spirit of the invention, all of which are contemplated as falling within the scope of the appended claims. Without further elaboration, it is believed that one of ordinary skill in the art can, using the preceding description, utilize the present invention to its fullest extent.

REFERENCES

The following references have been cited in the present specification. All cited references are expressly incorporated by reference herein.

1. Bojrab, D. I., Semi-Implantable Hearing Device: A Preliminary Report, paper presented at the Middle Section Meeting of the Triologic Society, Ann Arbor, Mich., Jan. 24, 1988.

2. Goode, R. L., Audition via Electromagnetic Induction, *Arch. Otolaryngol.* (1973), 98, pp. 23–26.

3. Goode, R. L., Current Status of Electromagnetic Implantable Hearing Aids, *Otolaryngologic Clinics of North America* (1989) 22(1), pp. 201–209.

4. Halliday, D., and Resnick, R. *Physics,* 3rd ed., J. Wiley, New York (1978), pp. 99–100.

5. Hurst, H. N., U.S. Pat. No. 3,710,399, Jan. 16, 1973 (not assigned), Ossicle Replacement Prosthesis.

6. Kinloch, A. J., *Adhesion and Adhesives Science and Technology,* 1st ed., Chapman and Hall, Cambridge University Press, London (1987), p. 185.

7. Maniglia, A. J., Ko, W. H., Zhang, R. X., Dolgin, S. R., Rosenbaum, M. L. and Montague Jr., F. W., *Electromagnetic Implantable Middle Ear Hearing Device of the Ossicular-Stimulating Type: Principles, Designs, and Experiments,* 1988, 97(6), pp. 1–16.

8. Rutschmann, J., Magnetic Audition—Auditory Stimulation by Means of Alternating Magnetic Fields Acting on a Permanent Magnet Fixed to the Eardrum, *IRE Transactions on Medical Electronics* (1959), 6, pp. 22–23.

9. Heide, J., Taige, G., Sander, T., Gooch, T., Prescott, T., Development of a Semi-Implantable Hearing Device, *Adv. Audiology,* (1987) Vol. 4, pp. ——. . . (1987).

10. Decraemer, W. F., Dirckx, J. J. J., Funnell, W. R. J., Shape and Derived Geometrical Parameters of the Adult, Human Tympanic Membrane Measured With a Phase-Shift Moire' Interferometer, Hearing Research (1991) pp. 107–122.

APPENDIX A

STANDARD OPERATING PROCEDURE
FOR TYMPANIC CONTACT TRANSDUCER
TABLE OF CONTENTS 1.0 DESCRIPTION

APPENDIX A-continued

STANDARD OPERATING PROCEDURE
FOR TYMPANIC CONTACT TRANSDUCER
TABLE OF CONTENTS 2.0 GENERAL
- 2.1 List of Chemicals
- 2.2 List of Equipment
- 2.3 List of Tools 3.0 STANDARD OPERATING PROCEDURE
- 3.1 Preparation of Negative Impression and Tools
- 3.2 Preparation of Positive Mold
- 3.3 Preparation of the TCT Lens Material
- 3.4 Preparation of TCT
- 3.5 Final Preparation of TCT for Patient Use 1.0 DESCRIPTION This document defines the materials, equipment and manufacturing procedures for the Tympanic Contact Transducer (TCT).

2.0 GENERAL 2.1 List of Chemicals
- Negative Impression
- Glutaraldehyde-30 Solution
- Self-Curing Silicone, two parts
- Audacryl RTC Modified Beige 23071, Part number 10211-000
- Methyl methacrylate liquid monomer, clear
- Mineral Oil
- Dow Corning medical grade SILASTIC ® MDX4-4210, Base and Catalyst
- 70% Isopropyl Alcohol
- Alcohol Prep. Kenndal/Webcol #6818

2.2 List of Equipment
- Microscope, Zeiss OP1 Stereo
- Balance Metler AE100
- Oven, Thelco Model 18

2.3 List of Tools
- Safety Glasses
- Surgical Latex Gloves
- Spatula, Precista-342, Med.
- Petri Dish, Small
- Tweezers and Holder, X-Acto, 6" Tweezers
- Tweezers, Excelta 3SA Stainless Antimagnetic
- Cup-Dixie 5 oz.
- Plastic Cap, Small
- Double-edge Sickle Knife, Storz N 1705-H
- Cotton Tip Applicator, 6" length
- 50 ml Beaker
- 30 ml Beaker
- 15 ml Beaker
- Stainless Steel Container POLAR S405
- Paper Towel 3.0 STANDARD OPERATING PROCEDURE 3.1 Preparation of Negative Impression and Tools 3.1.01 Put on surgical latex gloves 3.1.02 Fill the 30 ml Beaker with 15 ml of glutaraldehyde-30

3.1.03 Use tweezers to pick up the negative impression into the glutaraldehyde-30 to disinfect for 15 minutes. Do no use hands to touch the negative impression prior to disinfection. After disinfection, wash the negative impression with tap water and dry with paper towel.

3.1.04 Inspect the surface of the disinfected negative impression under microscope to determine wheter there are surface imperfections such as surface unevenness.

3.1.05 If surface imperfections are present, use the end of the spatula to pick the repair material, the pre-mixed two parts self-curing silicone, to fill and smooth the surface. Use microscope for this operation 3.1.06 After repair, use tweezers to hold the negative impression and use a tweezers holder to hold tweezers. The negative impression will be held in this position until Operation 3.2.04

3.1.07 Place 500 ml of glutaraldehyde-30 into the stainless steel container Place spatula and double-edged Sickle knife into the APPENDIX A-continued

STANDARD OPERATING PROCEDURE FOR TYMPANIC CONTACT TRANSDUCER TABLE OF CONTENTS above bath for 15 minutes for disinfection.

3.2 Preparation of Positive Mold 3.2.01 Weight 10 ± 0.05 grams of Audacryl RTC modified beige powder on Metler Balance AE100 into the Dixie cup.

3.2.02 Pour 7 ml of refrigerated methyl methacrylate monomer, clear into a 15 ml Beaker. Add the monomer in the Beaker slowly into the Dixie cup containing the beige powder. Mix well with a spatula. Degas for 15 minutes at 28–30 in Hg. Work under the hood or in a well-ventilated environment.

3.2.03 Use a spatula to scoop up the positive mold paste prepared in Operation 3.2.02 to the plastic cap. Fill the plastic cap to the rim.

3.2.04 Position the negative impression held by tweezers and tweezers holders (Operation 3.1.06) so that the circumference of the entire tympanic membrane is parallel to the surface of the table.

3.2.05 Bring the negative impression properly oriented in Operation 3.2.04 to gently impress onto the positive mold paste prepared in Operation 3.2.03

3.2.06 Wait for approximately 30 minutes until the positive mold paste is hard to the touch of the fingers.

3.2.07 Check to see whether the negative impression and the positive mold fit each other snugly. If there is too much the movement of the negative impression in the positive mold, the fit is not considered good and a new positive mold has to be made again.

3.3 Preparation of the TCT Lens Material 3.3.01 Wear surgical latex glove.

3.3.02 Weigh 1.0 ± 0.05 grams of Dow Corning medical grade SILASTIC ® MDX4-4210 part A, base, into a small petri dish.

3.3.03 Weigh 0.01 ± 0.005 grams of Dow Corning medical grade SILASTIC ®MDX4-4210 part B, catalyst, into the same petri dish.

3.3.04 Mix well with a spatula and degas under vacuum at 28–30 in Hg for 3 minutes.

3.3.05 Keep the SILASTIC ® in the vacuum oven until Operation 3.4.04.

3.4 Preparation of TCT 3.4.01 Clean the surface of the positive mold and the magnet with 70% isopropanol by wiping with Alcohol Prep.

3.4.02 Coat the surface of the positive mold with a very thin film of Mineral Oil.

3.4.03 Sharpen the wood end of the cotton tip applicator and use this end as the applicator.

3.4.04 Use the sharpened cotton tip appllicator to pick up degased SILASTIC ® prepared in 3.3.05.

3.4.05 Gently tilt the positive mold until the circumference of the tympanic membrane is parallel to the tables surface.

3.4.06 Work under the microscope and use a sharpened cotton tip applicator to gently place a very small amount of SILASTIC ® around the circumference above the umbo area to create a ring defining the edge and diameter of the final TCT. Avoid to use the material that has air bubbles.

3.4.07 Use a microscope and a cotton tip applicator to fil up the umbo coned area with the SILASTIC ®.

3.4.08 Use a microscope and cotton tip applicator to place a drop of SILASTIC ® on the edge (or any unused area) of the positive mold and create a small puddle.

3.4.09 Use a microscope and pick up the magnet with a pair of non-magnetic tweezers. Place the magent in the "puddle" created in Operation 3.4.08. Gently coat the magnet with SILASTIC ® by using a cotton tip applicator and by turning the magnet around to ensure complete coating.

3.4.10 Use a microscope and place the magnet gently onto the umbo area of the positive mold already coated with SILASTIC ® (Operation 3.4.06 and 3.4.07).

3.4.11 Place the TCT assembly prepared in Operation 3.4.10 into a pre-heated oven at 100° C. for 15 minutes.

3.4.12 Remove the TCT assembly from the oven and place it on bench and let cool.

3.5 Final Preparation of TCT for Patient Use 3.5.01 Use a microscope and a double-edged sickle knife to dissect the TCT assembly off the positive mold. Use extreme care to avoid damages to the TCT.

3.5.02 Remove TCT from the positive mold and place it in a 50 ml Beaker containing 30 ml of 70% isopropyl alcohol for 10 minutes.

3.5.03 Use a cotton tip applicator soaked with 70% isopropyl alcohol to wipe the surface of the positive mold.

3.5.04 Removed TCT from Beaker containing 70% isopropyl alcohol and place it back to the positive mold. Add a couple of drops of mineral oil between the TCT and the positive mold. The TCT is ready for patient use.

What is claimed is:

1. A hearing system for imparting audio information to an individual by vibrating the tympanic membrane of the individual, comprising:

(a) signal producing means for producing signals containing audio information; and (b) a contact transducer assembly that includes;

(i) transducer means responsive to said signal to produce vibrations representing said audio information; and (ii) support means attached to said transducer means, said support means being comprised at least partially of a non-reactive pre-formed biocompatible material having a contact surface of an area and configuration sufficient for manually releasably supporting said transducer means on the external surface of the tympanic membrane.

2. A hearing system as defined in claim 1, in which said transducer means comprises a permanent magnet.

3. A hearing system as defined in claim 2, in which said permanent magnet is comprised of a high energy permanent magnet.

4. A hearing system as defined in claim 1, in which said transducer means has a substantially tapered shape.

5. A hearing system as defined in claim 1, in which said signals containing said audio information are electromagnetic signals.

6. A hearing system as defined in claim 1, in which said support means further comprises a housing at least partially enclosing said transducer means.

7. A hearing system as defined in claim 6, in which said housing completely encapsulates said transducer means.

8. A hearing system as defined in claim 1, in which said support means comprises a plurality of layers of biocompatible material.

9. A hearing system as defined in claim 1, including a surface wetting agent interposed between said contact surface of said support means and the tympanic membrane.

10. A method for imparting audio information to an individual by vibrating the tympanic membrane of the individual, comprising the steps of:

(a) providing a contact transducer assembly responsive to electromagnetic signals;

(b) manually releasably securing said contact transducer assembly to the external surface of the tympanic membrane to impart vibrations from said contact transducer assembly to the external surface of the tympanic membrane; and (c) producing audio-modulated electromagnetic signals to vibrate said contact transducer assembly.

11. A method for imparting audio information to an individual as defined in claim 10, in which said transducer means comprises a permanent magnet.

12. A method for imparting audio information to an individual as defined in claim 11, in which said permanent magnet comprises a high energy permanent magnet.

13. A contact transducer assembly for a hearing system, comprising:

(a) transducer means responsive to electromagnetic signals to produce vibrations containing audio information; and (b) support means including a contact surface having a surface area and configuration sufficient to manually releasably support said transducer means on the external surface of the tympanic membrane.

14. A contact transducer assembly as defined in claim 13, in which said transducer means comprises a permanent magnet.

15. A contact transducer assembly as defined in claim 14, in which said permanent magnet is comprised of a high energy permanent magnet.

16. A contact transducer assembly as defined in claim 13, in which said transducer means has a substantially tapered shape.

17. A contact transducer assembly as defined in claim 13, in which said support means further comprises a housing at least partially enclosing said transducer means.

18. A contact transducer assembly as defined in claim 13, in which said housing completely encapsulates said transducer means.

19. A contact transducer assembly as defined in claim 13, in which said support means comprises a plurality of layers of biocompatible material.

20. A contact transducer assembly as defined in claim 13, including a surface wetting agent interposed between said contact surface and the tympanic membrane.

* * * * *

UNITED STATES PATENT AND TRADEMARK OFFICE

CERTIFICATE OF CORRECTION

PATENT NO. : 5,259,032

DATED : November 2, 1993

INVENTOR(S) : Perkins, *et al.*

It is certified that error appears in the above-identified patent and that said Letters Patent is hereby corrected as shown below:

Column 1, line 11, delete "stems" and insert therefor — relates to hearing systems—.

Column 7, lines 61-62, "bi-ocompatible" should be —bio-compatible—.

Column 9, line 39, "1 1 0" should be —110—.

Column 14, line 40, "50 ml" should be —50-ml—.

Column 14, line 41, "30 ml" should be —30-ml—.

Column 14, line 42, "15 ml" should be —15-ml—.

Column 14, line 47, "30 ml" should be —30-ml—.

Column 14, line 47, "15 ml" should be —15-ml—.

Column 14, line 50, "no" should be —not—.

Column 14, line 56, "wheter" should be —whether—.

Column 14, line 64, after "hold" insert —the—.

Column 15, line 8, "Weight" should be —Weigh—.

Column 15, line 11, "15 ml" should be —15-ml.

Column 15, line 54, "appllicator" should be —applicator—.

Column 15, line 57, "tables" should be —table—.

Column 16, line 25, "50 ml" should be —50-ml—.

Column 16, line 66, "6" should be —1—.

UNITED STATES PATENT AND TRADEMARK OFFICE

CERTIFICATE OF CORRECTION

PATENT NO. : 5,259,032

DATED : November 2, 1993

INVENTOR(S) : Perkins, *et al.*

It is certified that error appears in the above-identified patent and that said Letters Patent is hereby corrected as shown below:

Column 2, line 22, "has" should be —as—.

Column 6, line 56, after "2F" delete comma ",".

Column 7, line 30, after "of" insert —7—.

Column 8, line 1, "be", second occurrence, should be —by—.

Column 8, line 4, "eardrum" should be —eardrums—.

Column 8, line 6, after "techniques" insert comma —,—.

Column 12, line 23, "semi dry" should be —semi-dry—.

Column 14, line 65, after "3.2.04" insert period —.—.

Column 14, line 68, after "container" insert period —.—.

Column 15, line 27, after "3.2.03" insert period —.—.

Column 15, line 63, delete "Avoid to" and insert therefor —Avoid the use of—.

Column 15, line 66, "fil" should be —fill—.

Signed and Sealed this

Fourteenth Day of June, 1994

Bruce Lehman

*Attest:*

BRUCE LEHMAN

*Attesting Officer*

*Commissioner of Patents and Trademarks*